350-46.1 SR
1/4/83 XR 4,367,460

United States Patent [19]

Hodara

[11] 4,367,460

[45] Jan. 4, 1983

[54] INTRUSION SENSOR USING OPTIC FIBER

[76] Inventor: Henri Hodara, 2113 Minoru Dr., Altadena, Calif. 91001

[21] Appl. No.: 85,671

[22] Filed: Oct. 17, 1979

[51] Int. Cl.[3] ..... G08B 13/04; G08B 13/18

[52] U.S. Cl. ..... 340/550; 250/215; 250/221; 340/545; 340/555; 350/96.1; 350/96.34

[58] Field of Search ..... 340/545, 550, 555, 556, 340/557, 541; 250/215, 221; 350/259, 260, 96.1, 96.11, 96.34; 455/612

[56] References Cited

U.S. PATENT DOCUMENTS

| | | | |
|---|---|---|---|
| 2,311,613 | 2/1943 | Slayter | 350/96.34 X |
| 3,320,114 | 5/1967 | Schultz | 350/96.34 X |
| 3,594,770 | 7/1971 | Ham et al. | 340/550 |
| 3,634,845 | 6/1972 | Colman | 340/550 X |
| 3,714,644 | 1/1973 | Hellstrom | 340/556 X |
| 3,947,837 | 3/1976 | Bitterice | 340/550 |
| 4,175,827 | 11/1979 | McMahon | 455/612 X |
| 4,195,907 | 4/1980 | Zanja et al. | 350/96.1 X |
| 4,217,488 | 8/1980 | Hubbard | 455/612 |
| 4,228,425 | 10/1980 | Cooke | 340/550 |
| 4,234,875 | 11/1980 | Williams | 340/550 |

FOREIGN PATENT DOCUMENTS

| | | | |
|---|---|---|---|
| 761245 | 3/1934 | France | 340/550 |
| 2356961 | 3/1978 | France | 340/545 |
| 2379869 | 10/1978 | France | 340/557 |
| 1446667 | 8/1976 | United Kingdom | 340/550 |
| 2013332 | 8/1979 | United Kingdom | 340/545 |
| 2038060 | 7/1980 | United Kingdom | 340/550 |
| 2046897 | 11/1980 | United Kingdom | 340/550 |
| 2046971 | 11/1980 | United Kingdom | 340/550 |

OTHER PUBLICATIONS

Snyder, A. W. and Mitchell, D. J., *Leaky Rays on Circular Optical Fibers, Journal of the Optical Society of America,* vol. 64, No. 5, May, 1974.

*Primary Examiner*—John W. Caldwell, Sr.
*Assistant Examiner*—Joseph E. Nowicki
*Attorney, Agent, or Firm*—Peter I. Lippman

[57] ABSTRACT

A transparent continuous optical fiber is embedded in a transparent panel made of glass or plastic, with the two ends of the fiber accessible from outside the panel for coupling to a visible or invisible light source and detector respectively. By nearly matching the refractive indices of the panel and the fiber, and using good-quality material for the fiber so that it does not scatter significant amounts of the light passing through it, the fiber can be made virtually invisible although it establishes a complete light circuit. Cutting or breaking through the panel at a point intersecting the fiber interrupts the light circuit and triggers an alarm.

22 Claims, 11 Drawing Figures

FIG. 1
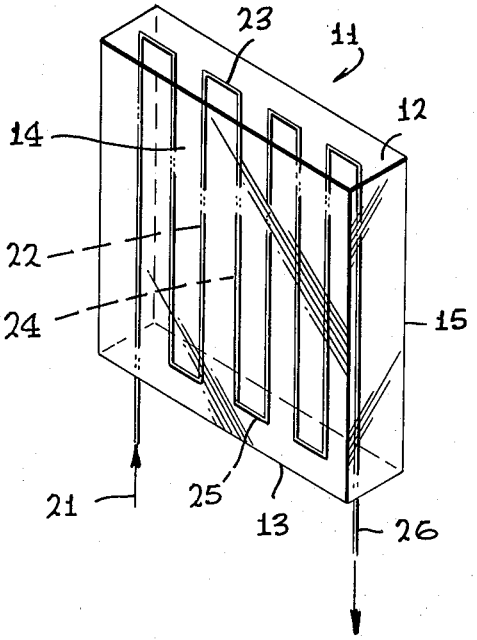
FIG. 2
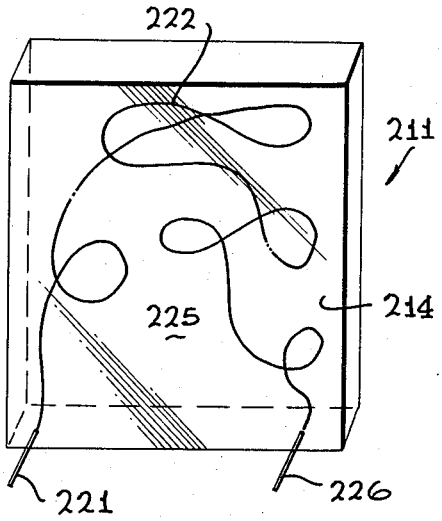
FIG. 4
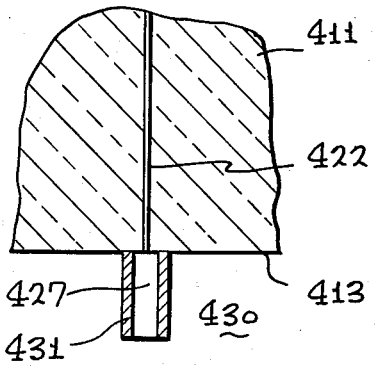
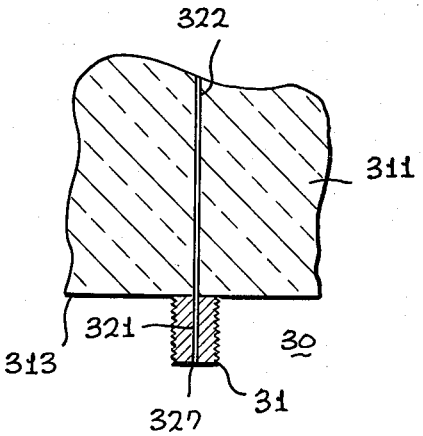
FIG. 3
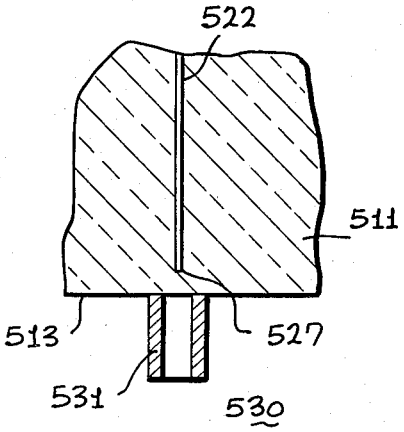
FIG. 5

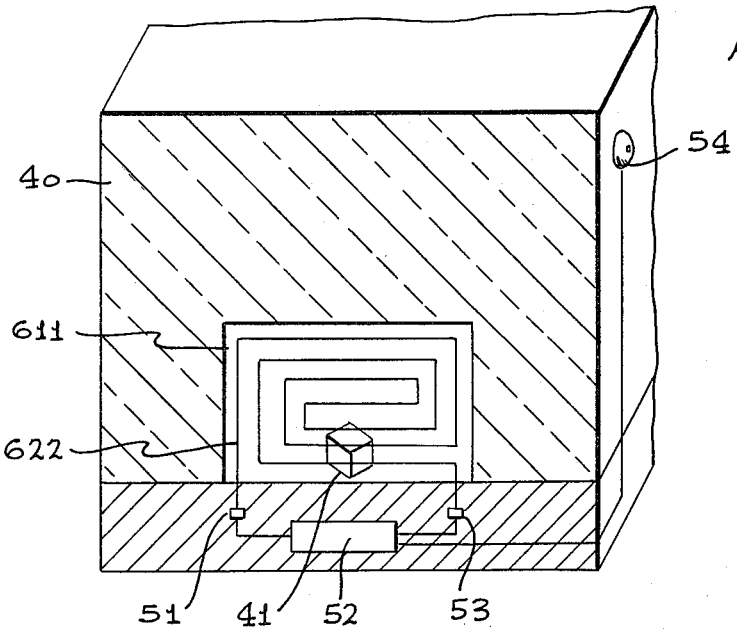
FIG. 6
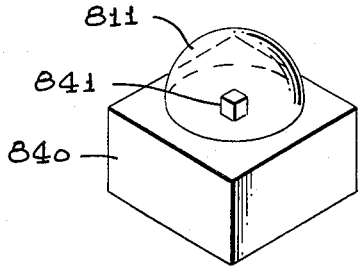
FIG. 8
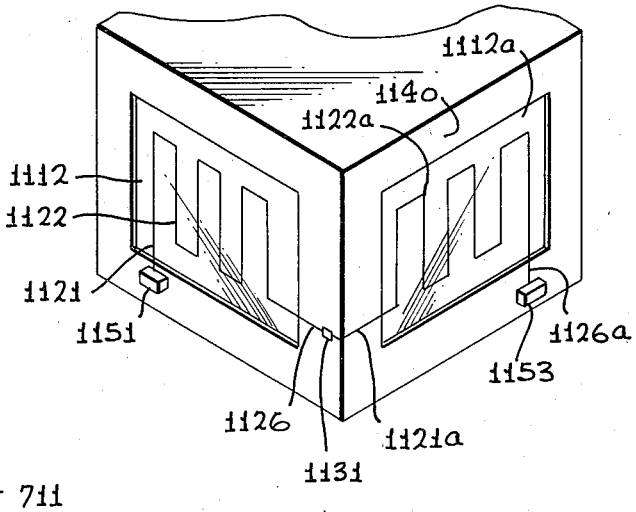
FIG. 11
FIG. 7
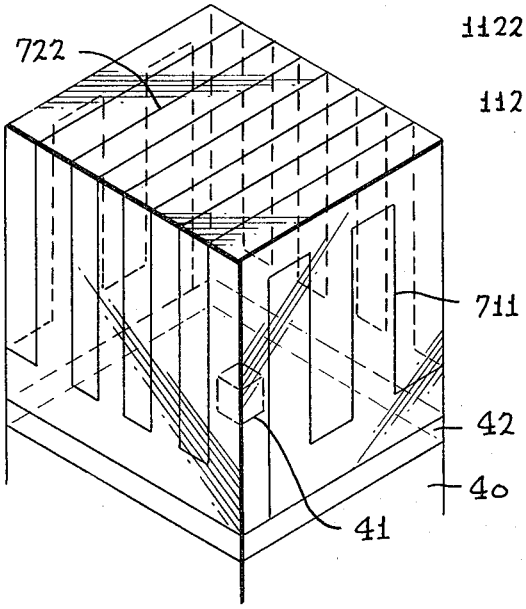
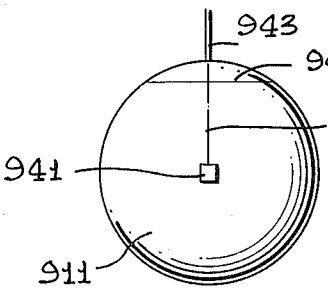
FIG. 9
FIG. 10
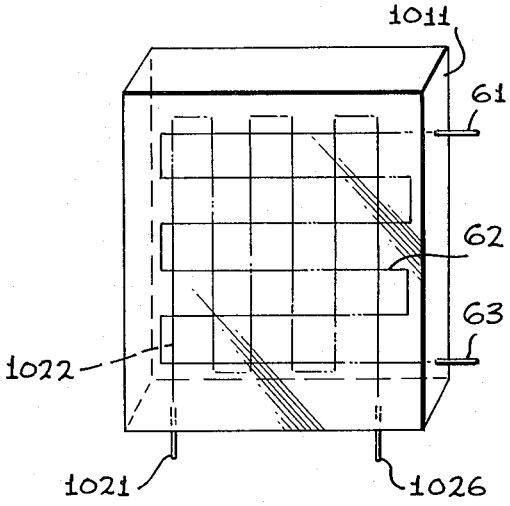

INTRUSION SENSOR USING OPTIC FIBER

BACKGROUND OF THE INVENTION

1. General Field

My invention is in the field of fiber optics, and also in the field of burglar alarms or intrusion sensors. In particular my invention relates to use of an optic fiber embedded in a transparent barrier or premises window, to generate an alarm signal when the barrier or window is breached.

2. Prior Art

Earliest burglar-alarm sensors were purely mechanical, involving linkages actuated by doors and windows, or cord stretched across apertures, to operate alarm bells. Later it became feasible to substitute an electrical circuit between the door-actuated "trip" or the stretched cord and an electrically-driven annunciator. Electrical systems in combination with glass windows naturally gave rise to the metallic-tape technique for store windows and sometimes display cases. With the advent of electric lights and photocells the light-beam system became popular for sensing entries, and secondarily for sensing unwanted intrusions.

All of the systems mentioned so far have two principal disadvantages:

(1) Coverage of protection is relatively gross in a geometric sense. That is, most actual systems of these types leave fairly extensive areas unprotected against sophisticated intruders able to cut their way into the guarded area at selected points. For example, a glass door which is protected by a switch that is operated when the door opens, and also protected by metallic tape around the edge of the glass, is breached by cutting the glass at a point not reached by the tape, and reaching inside to short-circuit the door switch, whereupon the door can be opened without sounding the alarm. Alternatively a thief can short-circuit the metallic tape, whereupon the glass can be breached or completely removed, likewise without sounding the alarm. If the tape were applied at such narrow intervals as to prevent such techniques, the result would be to defeat the purpose of using glass: much of the panel which is desired to be transparent would be obstructed by the metallic tape. The gross character of the protection is compounded by the fact that a prospective intruder can readily localize the protected areas, and apply his efforts elsewhere, because the tape, switches, strings, and optical beams are all relatively easy to see.

(2) Some of the same systems are also objectionable on esthetic grounds. The metallic tape, for instance, is quite conspicuous and in many instances may detract from the intended visual effect of a valuable display.

Some more-sophisticated systems operate by responding to sounds or other vibrations produced by intruders. These techniques usually obviate the two types of disadvantages mentioned above, but have two of their own:

(1) They are inappropriate to certain kinds of situations, in which the anticipated ambient noise or vibration level is normally high. For instance, in a busy museum setting the noise of conversation and moving visitors may be as high as, or higher than, the sound of an intrusion into a display case. Likewise, in a neighborhood where street noise and vibration levels are high even late at night, a sonic or vibration-sensitive system possibly cannot be set sensitive enough to respond to intrusion without its generating nearly constant false alarms due to the outdoors ambient noise or vibration.

(2) These systems are also nonspecific in another way—they tend to be tripped by inconsequential indoors events, such as an office cat knocking something over at night, or a watchdog barking at innocuous activity outdoors.

The most elaborate systems involve setting up fields—electric, electromagnetic, sonic, etc—in the space to be protected, and detecting disturbance of the fields by intruders. These systems represent a considerable improvement as to specificity of response, as compared with the sonic or vibration detectors, but are objectionably expensive. For some applications they are also too bulky, and they can be "temperamental."

My invention is directed to providing reliable and consistent protection of premises windows or transparent barriers, on as fine a geometrical grid as desired, in a way which is not merely inconspicuous but actually imperceptible, and at reasonable cost.

The invention is amenable to nonplanar, elaborately shaped display enclosures, such as transparent cylinders, domes, or even spheroids, as well as cubes, multifaced closed figures, and irregularly shaped enclosures.

I know of no prior art which approaches the concepts disclosed and claimed herein.

SUMMARY OF THE INVENTION

My invention provides a system for protecting against burglary or vandalism of valuable objects or premises. The system consists of two parts:

(1) The sensor is a special transparent panel that can be assembled or preformed into a box or irregularly shaped enclosure or made into a window, in such a way that any significant attempt by an intruder to penetrate it results in an alarm.

(By a "significant attempt" I mean one in which a hole is actually made in the sensor panel, and the hole is large enough for passage of an article being stolen, or a person, or an implement for otherwise negating the security of the enclosure, as the case may be.)

(2). The alarm-transmission subsystem sends an alarm signal to an annunciator—which may be part of a multipoint monitoring station where the time and place of penetration can be expeditiously determined and corrective action taken. The alarm signal can of course be transmitted to the annunciator or station by sound, radio or optical wave, or by cable, whether electrical, optical, fluidic, etc.

The alarm-transmission subsystem, which in many cases could be taken to include electronics and a light source and detector, is essentially conventional, can be assembled using commercially available components, and will not be detailed in this disclosure. However, in many other cases it is desirable that the light source and detector be physically incorporated with the sensor, as will be pointed out later; in these cases only the electronics would remain in the alarm-transmission subsystem.

The sensor consists of transparent panels made of glass or plastic, throughout which a transparent continuous optical fiber is embedded. The fiber is either all plastic or it is silica cladded with glass or plastic. The term "transparent" is used here and throughout this specification and the appended claims in its usual dictionary sense, which does not necessarily imply "colorless".

In the presently preferred embodiment of my invention, the fiber and panel are made of materials whose optical refractive indices nearly match each other, resulting in the fiber being invisible to the eye when no light is being transmitted along the fiber. The fiber is embedded in the panel as a continuous strand, the two ends typically being presented at or near a surface of the panel for optical coupling to a light source and detector respectively.

Thus a complete light circuit is established in the panel. Even when light is being transmitted along this optical circuit, the fiber can be invisible if (1) it is of such quality as to scatter a negligible fraction of that transmitted light, or (2) the light used is outside the visible part of the spectrum.

The electrical signal from the photodetector is of course usable in conventional ways to monitor the condition of the panel.

The principles and features introduced above, and their advantages, may be more-fully understood from the detailed disclosure hereunder, with reference to the accompanying drawings, of which:

BRIEF DESCRIPTION OF THE DRAWINGS

FIG. 1 is an isometric view of a sensor made in accordance with one embodiment of my invention.

FIG. 2 is a similar view of a sensor in accordance with another embodiment of my invention.

FIG. 3 is an orthographic or elevational view partly in cross-section and showing one arrangement for coupling a source or detector to the optical fiber of my invention.

FIG. 4 is a view similar to FIG. 3 but showing a different coupling arrangement.

FIG. 5 is a view similar to FIGS. 3 and 4 but showing yet another coupling arrangement.

FIG. 6 is a general isometric view, partly schematic, of a building with a show window protected by my invention.

FIG. 7 is a general isometric view of a museum case protected by my invention, wherein the protective sensor is a plurality of planar panels.

FIG. 8 is a view similar to FIG. 7 but wherein the sensor is a dome-shaped panel.

FIG. 9 is a view similar to FIGS. 7 and 8 but wherein the sensor is generally spheroidal.

FIG. 10 is a view similar to FIGS. 1 and 2 but wherein there are two separate optical fibers.

FIG. 11 is a view similar to FIG. 6 but showing a pair of protected show windows with their respective optical fibers connected in optical series.

DESCRIPTION OF PREFERRED EMBODIMENTS

Referring to FIG. 1, the panel 11 is a substantially transparent and solid, rigid panel of glass or plastic, having embedded in it an optic fiber 22, 23, 24, 25 whose ends 21 and 26 protrude from the bottom-edge surface 13 of the panel 11. Though convenient it is not required that both ends protrude from the same edge surface; with obvious realignments one or both of the ends 21 or 26 could be made to protrude from a different surface such as that of top edge 12; or, for that matter even from the front-face surface 14 or the rear-face surface 15, as convenient and preferred.

The fiber 21, 22, 23, 24, 25, 26 of FIG. 1 is arranged in a periodic pattern having longer segments 22, 24, and shorter or interperiodic connections 23, 25. The exact arrangement of the fiber is entirely a matter of convenience and preference. However, it is highly desirable to make the periodicity of any pattern which is used (that is, in this case, the lengths of the interperiodic segments 23, 25) shorter than the smallest thing whose passage through the panel is sought to be prevented—or, to put it more precisely, the smallest thing whose passage through the panel is to be sensed.

The smallest thing whose passage is to be sensed might be, in various cases, a piece of jewelry, or a burglary tool, or a person's arm, or an entire person, depending on circumstances; and this question could strongly affect the length of fiber required and the amount of labor and special technique required properly to lay out and embed the fiber in the panel. In other words, the size of the smallest thing to be precluded from passage, in relation to the total size of the transparent panel, may impinge strongly on overall cost.

To a certain extent the requirement that the periodicity be smaller than the smallest object whose passage is to be sensed is redundant or at least qualified, inasmuch as I prefer to practice the invention using an optical fiber which is invisible when embedded within the panel, as explained below. Where the fiber is invisible the periodicity may well be somewhat greater than the smallest thing to be protected, since an intruder would be statistically unlikely to make a hole of exactly the right size and in exactly the right location to pass the object to be protected without inadvertently intercepting and interrupting the fiber.

Two parameters control the visibility of the fiber within the panel: the difference between the refractive indices of the fiber and the panel, and the optical quality of the fiber itself. If the difference between the indices is very small, then very little diffraction of light occurs at the interface between the fiber and panel, and so an observer looking through the panel at objects behind it sees no perceptible distortion of those objects. Likewise very little reflection occurs at such an interface, so no perceptible glare or highlight due to light reflected from nearby light sources reveals the fiber's position. These considerations make the fiber invisible by ambient light. However, operation of the sensor requires optical-signal transmission along the fiber from one end to the other. To permit detection at the receiving end, the optical signal must be encoded in some way—as, for example, (1) by chopping or other modulation, or (2) by use of an intensity well above the maximum ambient light level that can scatter into the fiber and be confused with the signal. The latter approach in turn requires either use of signal wavelengths at which the ambient light is relatively dim (i.e., infrared or ultraviolet); or a high-quality optic fiber, so that visible light scattered from the optical signal outwardly from within the fiber does not render the fiber visible.

Although to attain invisibility of the fiber it is desired to make the difference between the refractive indices of panel and fiber very small, that difference cannot be made zero—for in that case the internal reflection characteristics of the fiber would be lost and the fiber would not function to transmit optical signals along its length. The signal would instead "leak" into the material of the panel, and would dissipate. In practice it is a matter of engineering to select a difference of indices which is within an optimum range, small enough to make the fiber invisible but large enough to give satisfactory transmission properties.

The question of what is "large enough" and what is "satisfactory" cannot be answered specifically here, for there are a number of engineering tradeoffs involving the intensity of the source, sensitivity of the detector, length of the fiber, anticipated ambient conditions, and the character of any encoding and decoding used. It is possible, however in investigating the operation of any completed system, to determine whether in fact reliable detection of an optical signal transmitted through the first is taking place, along with reliable exclusion of spurious optical "signals" such as ambient light. If so, then by that fact it may be said confidently that there is "adequate internal reflection within the fiber and adequate optical transmission through the fiber from one end to the other"—hence the use of this language in the appended claims.

Among the various design options is the use of optical fiber which is either all plastic or is silica cladded with glass or plastic. These options offer a range of optical, mechanical and thermal properties to accommodate desired performance parameters and construction techniques.

Embedded within the panel 211 of FIG. 2 is an optical fiber 222, disposed in a generally random way. The materials of fiber 222 and panel 211 may themselves by just the same as those employed in the sensor of FIG. 1, or they may represent a different set of solutions to the engineering problem described in the preceding paragraphs, as preferred.

The description of the locus of fiber 222 within the panel 211 as "generally random" is subject to two qualifications:

First, it is not intended to convey that a truly mathematical randomness must be obtained, but merely that a disposition having no particular regularity or apparent pattern of intelligence is acceptable.

Second, it is very desirable that the largest "open" or unprotected area of the panel, such as the area 225 of FIG. 2, have dimensions smaller than or at least comparable to those of the smallest thing whose passage through the panel is to be prevented or sensed. In other words, the randomness of the fiber locus is subject to a requirement analogous to that placed on the periodicity of the pattern in FIG. 1.

The point of using a "generally random" locus is that, should sensors of the type described here become common in commerce, a sophisticated criminal could obtain a panel of the same size as one which he intends to breach, and by careful examination with suitable instruments in a laboratory, or perhaps by a destructive examination, determine the exact locus of the fiber. If all sensor panels were systematically made identical or kept within a limited selection of periodicities, the criminal would then have a possibility of mapping the locus of the fiber within a sensor panel at the site of his intended intrusion. With a generally random locus, however, differing from panel to panel, this possibility of defeating the system would be minimized.

As in FIG. 1 the fiber 222 of FIG. 2 protrudes at its own ends 221 and 226 from the panel 211; but here the ends protrude from the front face 214 rather than an edge face. As previously noted, the face used for access to the fiber ends is a matter of design and installation convenience and preference.

In FIG. 3 the end 321 of the fiber 322 protrudes beyond the surface 313 of the panel 311, and is encased in a fitting 31, which is adapted for mechanical coupling of a mating fitting (not shown) associated with an optical source or detector. In this way the end 321 of the fiber 322 can be optically coupled with such a source or detector. Of course proper optical finishing of the fiber tip 327, as is well-known in the fiber-optics art, is required for good optical coupling.

It is not strictly necessary for the end of the fiber to protrude beyond the surface of the panel. For example, in FIG. 4 the tip 427 of the fiber 422 is substantially flush with the surface 413 of the panel 411; fitting 431, in the ambient air 430 outside the panel, is adapted for mechanical and optical coupling to a mating fitting associated with a light source or detector.

In most fiber-optics applications, scrupulous care is taken to obtain very accurate alignment of mating fibers, and intimate abutting contact of the precision-finished fiber tips. The application described here, however, is relatively undemanding as it involves only two interfaces—one at the source, and one at the detector. In addition, detectors can be selected with areas much larger than that of the fiber, to ensure that the detector collects all the light from the fiber; and the source can be chosen to have a narrow emission cone, and smaller area than the fiber, in order to efficiently couple its emitted light into the fiber. With such precautions, in some situations where signal strength is ample it may be possible to tolerate considerable misalignment between fiber and end devices (source and detector), or even to use a nonabutting optical coupling. In FIG. 5, for example, the tip 527 of the fiber 522 within the panel 511 stops short of the surface 513 of panel 511, but "points" toward the surface 513. A fitting 531 is adapted for mechanical coupling to a source or detector fitting (not shown), which the fitting 531 would "point" accurately toward the tip 527 and in adequate alignment with the fiber 522 for optical coupling therewith. Of course the fiber tip 427 of FIG. 4 or 527 of FIG. 5 must be suitably finished for good optical coupling. It will be apparent that many variations on the arrangements of FIGS. 3 through 5 are possible without departing from the scope of my invention; for instance, the surface 313 of FIG. 3, or 413 of FIG. 4, or 513 of FIG. 5 may be notched or cut in to form a recess for the fitting 31, 431 or 531, respectively, so that the fitting need not stick out, or need not stick out as far, into the ambient air as it does in FIGS. 3, 4 and 5. Such an arrangement would obviously facilitate handling and installation of the sensor panel as a commercial unit.

In the coupling variations discussed so far, the only common requirement is that the tip of the fiber be generally near the surface of the panel—whether protruding beyond, terminating flush with, or being enclosed within the panel material.

However, even this condition is not strictly required, as it is possible in principle for the fiber to continue uninterrupted for a considerable distance beyond the edge of the panel, to a relatively remote source or detector.

FIG. 6 represents a building or box 40 having a display window 611 beyond which a valuable object 41 or a plurality of such objects is displayed and/or stored. The window 611 is a sensor panel of the type already described, with an embedded optical fiber 622 connected to optical source 51 at one end and optical detector 53 at the other. Electronic pack 52 supplies power—modulated as desired—to source 51, and receives and interprets electrical signals from detector 53; and in turn generates control signals for transmission to an annunciator 54, which may be nearby as shown or may be in a remote monitoring location, as is common in the intrusion-alarm art. Of course the source 51, electronics 52, detector 53, annunciator 54 and their interconnections, as well as the coupling of the source 51 and detector 53 to the fiber 522, are concealed within the walls of the building or box 40.

FIG. 7 represents a sensor configured in an appropriate fashion for a museum piece. Here the sensor consists of five panels formed together as a unit 711, with but a single continuous optical fiber 722 running through all five panels. The ends of the fiber are optically coupled to a source, detector and electronics pack concealed within control-module strip 42, which is permanently attached to the transparent five-panel upper portion 711 of the sensor. An alternative to this construction scheme (illustration of which would involve only obvious and minor modifications to FIG. 7) is to make each of the five panels a separate sensor—each with its own fiber terminated at both ends outside the sensor panel. Power to and annunciator signals from the control-module strip are passed from and to corresponding circuits within the pedestal 40 through an electrical connector (not illustrated) at the interface between the strip 42 and pedestal 40.

Assuming resolution of obvious technical complications, the sensor of my invention can in principle be made in a great variety of curvilinear and other irregular shapes—such as, for example, a dome 811 upon a pedestal 840, displaying object 841, as in FIG. 8; or the spheroidal shell 911 of FIG. 9. In the latter case the displayed object 941 may be hung by a cord 942 within the shell, as illustrated, or may simply rest on the bottom of the shell interior. Plug section 940 may house a detector and source, with optical coupling to an optical fiber (not shown) running through the shell 911, and electrical connections led outward through support cable 943 to power source and annunciator or monitor elsewhere. Alternatively the optical fiber within the shell may continue through part of the plug section and through the support cable 943 to light source and detector units elsewhere. For certain kinds of gemstones or other transparent or reflective objects 941, the optical-fiber circuit may even be extended via the support cord 942 to pass through or be reflected from the object 941 itself, so that even if the shell is somehow breached the object cannot be removed without breaking the optical circuit.

While I prefer practice of my invention using an optical-fiber material whose index of refraction closely matches that of the panel, and whose freedom from scattering inclusions or imperfections is very good—so that as mentioned earlier the fiber is invisible—there is another school of thought in this regard. It may be preferred to make the fiber conspicuous, by use of a relatively highly scattering material or a mismatch of refractive indices. This might tend to deter some intruders from even attempting to breach the barrier, especially if the spacing between the adjacent segments of the fiber were obviously much less than the dimensions of a valuable object which might be the target of a prospective theft. Even with relatively closely spaced adjacent segments of the fiber, since the fiber is exceedingly small in diameter the interference with viewing of the displayed object would be relatively minor. Moreover, the pattern of the fiber locus within the panel might be chosen to harmonize with the display in some way. All such variations would be within the scope of my invention.

However, as I would prefer not to practice the invention in ways which would give away the exact locus of the fiber—for reasons set forth earlier—in cases where a fiber is deliberately made visible or even conspicuous I would also include a second optic fiber within the same panel, and make this second fiber invisible. This approach is suggested in FIG. 10, wherein panel 1011 is multiply traversed by a visible fiber 1022, whose ends 1021 and 1026 are accessible for optical coupling near the edge of the panel 1011 as previously described. In addition, a second fiber 62—which is invisible—also multiply traverses the panel 1011, and has ends 61 and 63 presented for optical coupling near the edge of the panel 1011. If desired the two fibers can be connected in series optically, as by an external fiber connection between their respective ends 63 and 1026, with the remaining two ends 1021 and 61 being connected to a source and a detector. Alternatively the two fibers can be connected independently to their own respective sources and detectors.

My invention does not necessarily require provision of one light source and detector for each sensor panel. It has already been shown in connection with FIG. 7 that a sensor may comprise several panels—with a single optic fiber running through all the panels. FIG. 7 emphasizes the potentialities of forming plural panels as a single piece, with the fiber passing several times back and forth between adjacent panels. In particular this is illustrated by the fiber configuration for the top, front left and right rear panels in FIG. 7. However, in that same illustration it is also shown that panels and groups of panels may be connected in optical series, as with respect to the right front and left rear panels of FIG. 7. This approach is illustrated in a different context in FIG. 11, where two physically separated sensor panels 1112 and **1112*a* in a building or display case 1140 have respective optical fibers 1122 and 1122*a*** connected in optical series.

Fiber 1122 receives light at entry segment 1121 from single source 1151 and emits light at termination 1126 via optical connector 1131 to entry segment **1121*a* of the second fiber 1122*a*, through which the light proceeds, exiting at 1126*a* to single detector 1153**. In practice a large plurality of separate fibers can share a single source and detector, if desired. It will be recognized that in such systems suitable separate provision may be desired for localizing the cause of a security alarm.

The foregoing disclosure is intended to be exemplary only, not to limit the scope of my invention—which scope is to be ascertained only by reference to the following claims.

I claim:

1. An intrusion sensor for use with an optical source and detector, and comprising:

a substantially transparent and solid panel; and a unitary optic fiber at least partly embedded in the panel and having each of its two ends near a surface of the panel;

wherein the panel and the portion of the fiber in contact therewith each have respective refractive indices, and the difference between the said respective refractive indices is sufficiently small to render the fiber substantially invisible to the eye; and the two ends are adapted, located and oriented for optical coupling of such optical source to such optical detector.

2. The sensor of claim 1, also comprising a second optic fiber embedded in the same panel, with its ends adapted, located and oriented for optical coupling to an optical source and detector, the second optic fiber being readily visible in use.

3. An intrusion sensor for use with an optical source and detector, and comprising:

a substantially transparent and solid panel; and a unitary optic fiber at least partly embedded in the panel and having each of its two ends near a surface of the panel;

wherein the panel and the portion of the fiber in contact therewith each have respective refractive indices, and the difference between the said refractive indices is sufficiently small to render the fiber substantially invisible to the eye but is also sufficiently large to maintain adequate internal reflection within the fiber and thus adequate optical transmission through the fiber from one end to the other; and the two ends are adapted, located and oriented for optical coupling to such optical source and detector, respectively.

4. The sensor of either claim 1 or claim 3, for use in sensing passage of particular articles, wherein:

the fiber is convoluted within the panel in such a way that passage through the panel, as through a break or cut intrusively made therein, of the smallest such article whose passage is sought to be sensed must necessarily intercept and interrupt the optic fiber.

5. The sensor of either claim 1 or claim 3, for use in sensing passage of particular articles, wherein:

the fiber is convoluted within the panel in such a way that passage through the panel, as through a break or cut intrusively made therein, of the smallest such article whose passage is sought to be sensed must necessarily intercept and interrupt the optic fiber; and also comprising:

optical fittings secured to the panel and adapted for mechanically locating such source and detector in operational relation with the two ends of the fiber, respectively;

such optical source and such optical detector, mounted to the panel in operative mechanical relation to the fittings and in operative optical relation with the respective two ends of the fiber and means for making functional electrical connections to the source and detector.

6. An intrusion sensor for use with an optical source and detector, and comprising:

a substantially transparent and solid panel; and a unitary optic fiber at least partly embedded in the panel and having two ends;

wherein the panel and the portion of the fiber in contact therewith each have respective refractive indices, and the difference between the said respective refractive indices is sufficiently small to render the fiber substantially invisible to the eye; and the two ends of the fiber are adapted, located and oriented for optical coupling of such optical source to such optical detector.

7. An intrusion sensor for use with an optical source and detector, and comprising:

a substantially transparent and solid panel; and a unitary optic fiber at least partly embedded in the panel and having two ends;

wherein the panel and the portion of the fiber in contact therewith each have respective refractive indices, and the difference between the said refractive indices is sufficiently small to render the fiber substantially invisible to the eye but is also sufficiently large to maintain adequate internal reflection within the fiber and thus adequate optical transmission through the fiber from one end to the other; and the two ends are adapted, located and oriented for optical coupling to such optical source and optical detector, respectively.

8. The sensor of either claim 6 or claim 7, for use in sensing passage of particular articles, wherein:

the fiber is convoluted within the panel in such a way that passage through the panel, as through a break or cut intrusively made therein, of the smallest such article whose passage is sought to be sensed must necessarily intercept and interrupt the optic fiber.

9. The sensor of claim 8, wherein the fiber is disposed in a substantially periodic pattern, with necessary interperiodic connections, the periodicity of the pattern being smaller than the smallest dimension of such smallest article.

10. The sensor of claim 8, wherein the fiber is disposed along a locus which is generally random except for the condition recited in claim 6.

11. The sensor of either claim 6 or claim 7, for use in sensing passage of particular things, wherein:

the fiber is convoluted within the panel in such a way that passage through the panel, as through a break or cut intrusively made therein, of the smallest such thing whose passage is sought to be sensed must necessarily intercept and interrupt the optic fiber; and also comprising:

optical fittings secured to the panel and adapted for mechanically locating such source and detector in operational relation with the two ends of the fiber, respectively;

such optical source and such optical detector, mounted in operative mechanical relation to the fittings and in operative optical relation with the respective two ends of the fiber; and means for making functional electrical connections to the source and detector.

12. The sensor of any one of claims 1, 3, 6 or 7, also comprising optical fittings secured to the panel and adapted for mechanically positioning such source and detector in operational relation with the two ends, respectively.

13. The sensor of any one of claims 1, 3, 6 or 7, wherein at least one of the said two ends of the fiber protrudes beyond the surface of the panel and is adapted for optical coupling outside the panel, to such source or detector.

14. The sensor of any one of claims 1, 3, 6 or 7, wherein at least one of the said two ends of the fiber is substantially flush with the surface of the panel and is adapted for optical coupling, at the surface of the panel, to such source or detector.

15. The sensor of any one of claims 1, 3, 6 or 7, wherein at least one of the said two ends of the fiber is inside the panel, and is adapted for optical coupling to such source or detector by means of optical transmission, between the surface of the panel and the said end, through the material of which the panel is made.

16. The sensor of any one of claims 1, 3, 6 or 7, also comprising:

such optical source and such optical detector, mounted to the panel in operative relation with the said two ends respectively; and means for making functional electrical connections to the source and detector.

17. An intrusion sensor comprising a plurality of sensors as recited in any one of claims 1, 3, 6 or 7, wherein the optic fiber of each one of said plurality of sensors is optically connected together in a single series optical circuit with the optic fibers of all of the other sensors in said plurality of sensors.

18. An intrusion-sensing system comprising a plurality of sensors as recited in any one of claims 1, 3, 6 or 7, wherein but a single continuous fiber passes through the respective panel of every one of said plurality of sensors, forming the respective fiber for each panel.

19. The sensor of claim 18 wherein the plural panels are formed as a single integral piece.

20. The sensor of any one of claims 1, 3, 6 or 7 wherein the panel is nonplanar.

21. The sensor of claim 20 wherein the panel is dome-shaped.

22. The sensor of claim 20 wherein the panel is a spheroidal shell.

* * * * *